US005992389A

United States Patent [19]

Ohsaki

[11] Patent Number: 5,992,389

[45] Date of Patent: Nov. 30, 1999

[54] APPARATUS AND METHOD FOR CONTROLLING FUEL INJECTION OF AN INTERNAL COMBUSTION ENGINE

[75] Inventor: Masanobu Ohsaki, Atsugi, Japan

[73] Assignee: Unisia Jecs Corporation, Kanagawa-ken, Japan

[21] Appl. No.: 09/058,416

[22] Filed: Apr. 10, 1998

[30] Foreign Application Priority Data

Apr. 22, 1997 [JP] Japan ..... 9-104757

[51] Int. Cl.[6] ..... F02D 41/14

[52] U.S. Cl. ..... 123/478

[58] Field of Search ..... 123/478, 480, 123/435

[56] References Cited

U.S. PATENT DOCUMENTS

| | | | |
|---|---|---|---|
| 4,499,879 | 2/1985 | Stoltman et al. | 123/480 |
| 4,753,206 | 6/1988 | Inoue et al. | 123/480 |
| 4,815,435 | 3/1989 | Lefevre et al. | 123/478 |
| 4,884,548 | 12/1989 | Sogawa | 123/478 |
| 4,886,027 | 12/1989 | Orrell et al. | 123/478 |
| 4,903,660 | 2/1990 | Sogawa | 123/478 |
| 5,113,832 | 5/1992 | Heffron | 123/478 |
| 5,394,849 | 3/1995 | Tomisawa | 123/478 |
| 5,522,365 | 6/1996 | Milunas et al. | 123/480 |
| 5,628,299 | 5/1997 | Marzonia et al. | 123/478 |

FOREIGN PATENT DOCUMENTS 3-12217 2/1991 Japan .

*Primary Examiner*—Willis R. Wolfe
*Assistant Examiner*—Hieu T. Vo
*Attorney, Agent, or Firm*—McDermott, Will & Emery

[57] ABSTRACT

An intake air temperature TC of a cylinder is estimated from an equation of TC=TA+HEXGIN (TA−TA)+273° K on the basis of a cylinder heat-transfer coefficient HEXGIN, an intake air temperature TA and a cooling water temperature TW. An operation of a first correction coefficient KTA is carried out on the basis of an equation KTA=TTC/TC with the use of an intake air temperature TTC estimated under reference environment. Next, an operation of a finally correction coefficient KTAHOS is carried out on the basis of an equation of KTAHOS=KTA×[1.0−{(KTA−1.0)×KCHOS}] with the use of an air density fine adjustment coefficient KCHOS, and then, by taking advantage of the finally correction coefficient KTAHOS, a fuel injection quantity based on an intake air pressure is corrected.

12 Claims, 4 Drawing Sheets

APPARATUS AND METHOD FOR CONTROLLING FUEL INJECTION OF AN INTERNAL COMBUSTION ENGINE

BACKGROUND OF THE INVENTION (1) Field of the Invention

The present invention relates to an apparatus and a method for controlling fuel injection of an internal combustion engine, and more particularly, to a technique of making correction on a fuel injection quantity in accordance with an intake air temperature (intake air density) in an internal combustion engine of controlling a fuel injection quantity on the basis of an intake air pressure.

(2) Related Art of the Invention

Conventionally, in an internal combustion engine of controlling a fuel injection quantity on the basis of an intake air pressure, a correction on fuel injection quantity has been carried out in accordance with a change of an intake air temperature (intake air density).

For example, Japanese Examined Patent Publication No. 3-12217 discloses a construction such that an intake air temperature is detected by means of an intake air temperature sensor provided on the midway of an intake manifold; a correction value for correcting a fuel injection quantity is computed on the basis of the intake air temperature detected by the intake air temperature sensor; the correction value is corrected in accordance with an intake manifold temperature to calculate the final correction value; and a basic fuel injection quantity is corrected in accordance with an intake air pressure.

However, according to the aforesaid method disclosed in Japanese Examined Patent Publication No. 3-12217, in order to precisely make correction in accordance with an intake air temperature of a cylinder, a change ratio of the final correction value corresponding to the change of intake air temperature needs to be adapted for each temperature of the intake manifold. For this reason, there has arisen a problem that the number of additional adaptation processes is much required.

SUMMARY OF THE INVENTION

The present invention has been made taking the aforesaid problem in the prior art into consideration. It is, therefore, an object of the present invention to precisely make a correction on fuel injection quantity in accordance with an intake air temperature without increasing the number of additional adaptation processes.

To achieve the above object, the present invention provides an apparatus and a method for controlling a fuel injection of an internal combustion engine, which computes a deviation between an intake air temperature of an intake manifold and a temperature of the intake manifold, estimates an intake air temperature of a cylinder on the basis of the deviation and the intake air temperature of the intake manifold, and corrects a fuel injection quantity based on an intake air pressure on the basis of the estimated result.

With the above construction of the present invention, assuming that a temperature variation until an intake air passed through a portion detecting an intake air temperature is sucked in the cylinder, is generated in accordance with a deviation between a detection value of the intake air temperature and the temperature of the intake manifold, the intake air temperature of the cylinder can be estimated.

The cylinder intake air temperature may be estimated on the basis of an equation of TC=TA+HEXGIN (TW−TA) in a manner that when the intake air temperature detected in the intake manifold is set as TA, the intake manifold temperature is set as TW and the intake air temperature of the cylinder is set as TC, a previously stored cylinder heat-transfer coefficient HEXGIN is used.

With the above construction of the present invention, assuming that the temperature varies by predetermined ratio of the deviation between the intake manifold temperature TW and the intake air temperature TA between the portion where the intake air temperature is detected and the cylinder, the cylinder intake air temperature TO can be computed. Therefore, by matching only cylinder heat-transfer coefficient HEXGIN prescribing the predetermined ratio, it is possible to estimate the cylinder intake air temperature inclusive of the influence of the intake manifold temperature.

In order to set a correction value on the basis of the cylinder intake air temperature estimated as described above, a first correction amount may be computed on the basis of a previously stored reference cylinder intake air temperature and the estimated cylinder intake air temperature, and thereafter, a finally second correction amount may be computed on the basis of the first correction amount and a previously stored adjustment coefficient.

With the above construction of the present invention, on the basis of the previously stored reference cylinder intake air temperature and the estimated cylinder intake air temperature, a correction amount corresponding to the current intake air temperature is set as the first correction amount by making a correction amount required at the time of the reference cylinder intake air temperature as a reference. Further, based on the first correction amount and a previously stored adjustment coefficient, a second correction amount for adjusting an error of the first correction amount is computed, and then, the fuel injection quantity is corrected on the basis of the second correction amount.

Preferably, the reference cylinder intake air temperature is an intake air temperature of the cylinder which is computed on the basis of the intake air temperature and intake manifold temperature to be references.

With the above construction of the present invention, the result estimated under the reference intake air temperature, intake manifold temperature (reference environment) is previously stored as a reference cylinder intake air temperature. And then, a correction amount corresponding to the current environment condition is set as the first correction amount on the basis of the reference intake air temperature, the intake air temperature at this time, the cylinder intake air temperature obtained from the detection result of the intake manifold temperature by making the correction amount required under the reference environment as a reference.

Preferably, the reference environment is a state that the intake manifold temperature and the intake air temperature are near to the normal temperature.

The operation of the first and second correction amounts may be carried out in a manner that when the reference cylinder intake air temperature is set as TTC, the estimated cylinder intake air temperature is set as TC and the first correction amount is set as KTA, an operation of the first correction amount KTA is carried out on the basis of an equation of KTA=TTC/TC, and that when the adjustment coefficient is set as KCHOS and the second correction amount is set as KTAHOS, an operation of the finally second correction amount KTAHOS is carried out on the basis of an equation of KTAHOS=KTA ([1.0−{(KTA−1.0)×KCHOS}].

With the above construction of the present invention, the first correction amount KTA is computed as a ratio of the reference cylinder intake air temperature TTC and the estimated cylinder intake air temperature TC. However, the intake air temperature ratio and the required correction amount ratio do not necessarily coincide with each other. For this reason, by taking advantage of an operation of the second correction amount KTAHOS, in the case where the correction level by the first correction amount KTA becomes greater (the absolute value of the deviation between KTA and the value 1.0 becomes greater), the correction level is made smaller so as to correspond to the actual correction requirement.

Also, since the second correction amount KTAHOS is a correction term to be multiplied to the fuel injection quantity, when KTAHOS equals to 1.0, the correction is not substantially made. If KTAHOS>1.0, an increase correction is made; on the other hand, if KTAHOS<1.0, an decrease correction is made.

The intake manifold temperature is representative of a cooling water temperature of an internal combustion engine.

With the above construction of the present invention, the cooling water temperature is regarded as nearly equaling to the intake manifold temperature (the wall face temperature of the intake air passage), and then, the change of the intake air temperature after detected is estimated on the basis of the cooling water temperature.

The other objects and features of the present invention will be apparent from the description of an embodiment set forth below, with reference to the accompanying drawings.

PREFERRED EMBODIMENT

An embodiment of the present invention will be described below.

Figure 1:
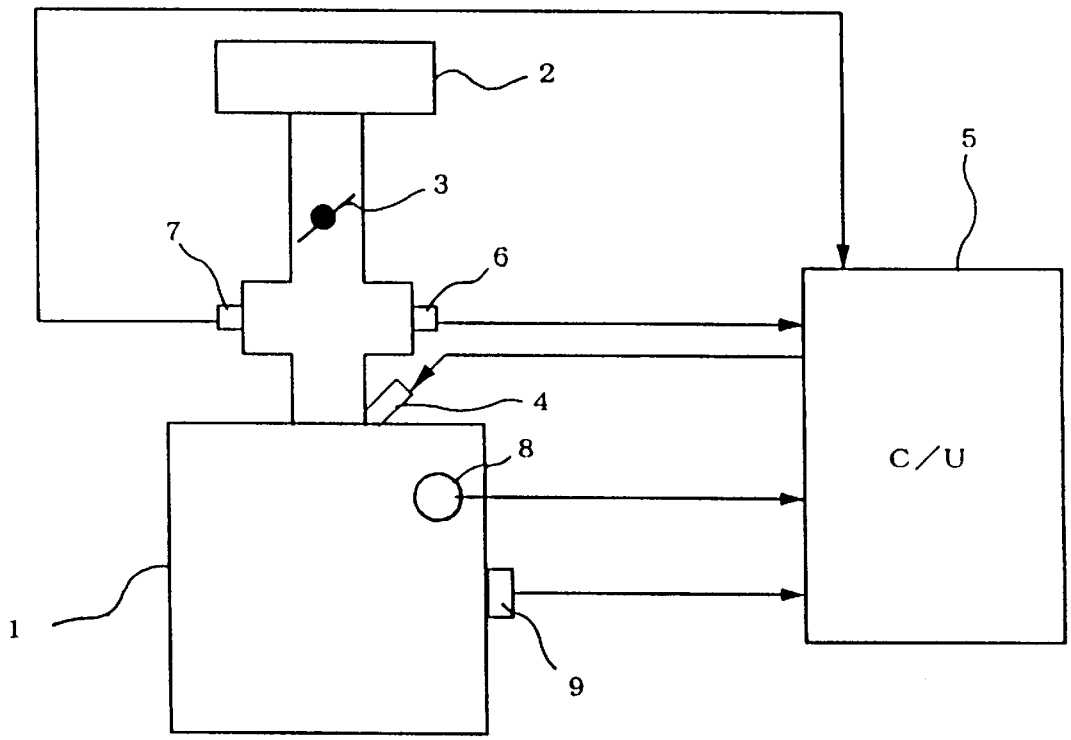
FIG. 1 is a system configuration diagram of an internal combustion engine according to an embodiment of the present invention.

FIG. 1 is a system configuration diagram of an internal combustion engine according to the embodiment. In an internal combustion engine 1, an intake air passed through an air cleaner 2 is adjusted by means of a throttle valve 3, and then, is sucked in a cylinder. Further, the intake air is mixed with a fuel injected by a fuel injection valve 4, and an air-fuel mixture is formed. The formed air-fuel mixture is ignited and burned by spark ignition of an ignition plug.

To a control unit 5 electronically controlling the fuel injection valve 4, detection signals from various sensors are input. The control unit 5 computes a fuel injection pulse width (fuel injection quantity) by the fuel injection valve 4, and then, outputs an injection pulse signal corresponding to the pulse width to the fuel injection valve 4.

As these various sensors, there are provided an intake air pressure sensor 6 (intake air pressure detecting device) which detects an intake air pressure PB on a downstream side of the throttle valve 3, an intake air temperature sensor 7 (intake air temperature detecting device) which detects an intake air temperature TA at an intake manifold portion on the downstream side of the throttle valve 3, a water temperature sensor 8 which detects a cooling water temperature TW of the engine 1, a rotation sensor 9 which detects a rotational speed of the internal combustion engine 1, or the like.

In this embodiment, the aforesaid cooling water temperature TW is regarded as an intake manifold temperature; therefore, the water temperature sensor 8 is equivalent to an intake manifold temperature detecting device.

Figure 2:
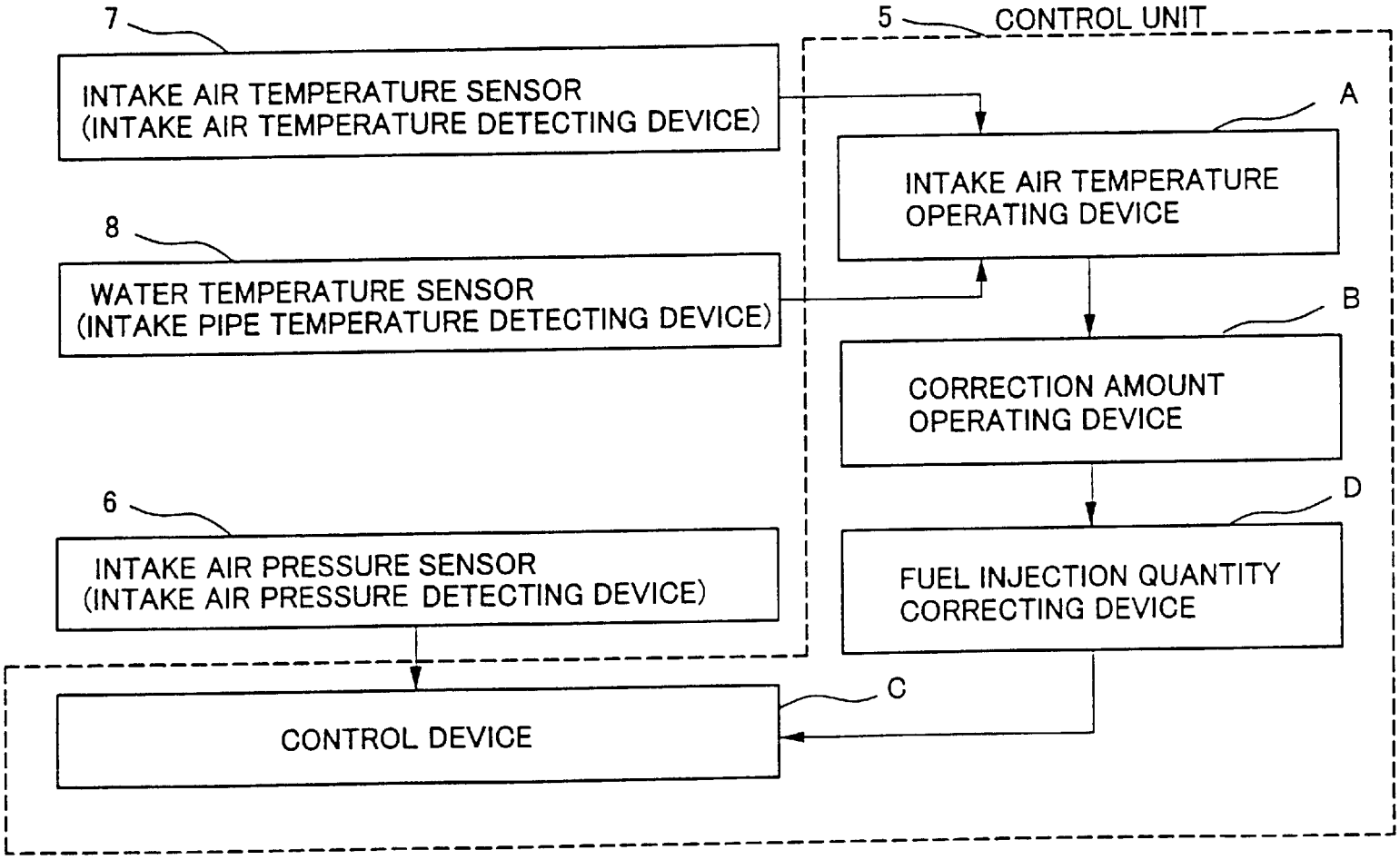
FIG. 2 is a control block diagram schematically showing a fuel injection control according to the above embodiment of the present invention.

The control unit 5 controls a fuel injection quantity of the fuel injection valve 4 in a manner as shown in the control block diagram of FIG. 2.

More specifically, an intake air temperature operating device A computes an intake air temperature in a cylinder on the basis of an intake air temperature TA detected by the intake air temperature sensor 7 and a cooling water temperature TW detected by the water temperature sensor 8. And then, a correction amount operating device B computes a correction amount for correcting a fuel injection quantity on the basis of the computed intake air temperature of the cylinder. A control device C computes a fuel injection quantity on the basis of an intake air pressure detected by the intake air pressure sensor 6; on the other hand, a fuel injection correcting device D corrects the fuel injection quantity on the basis of the correction amount computed by the correction operating device B.

Next, the fuel injection control will be described below in detail with reference to flowcharts shown in FIG. 3 and FIG. 4.

Figure 3:
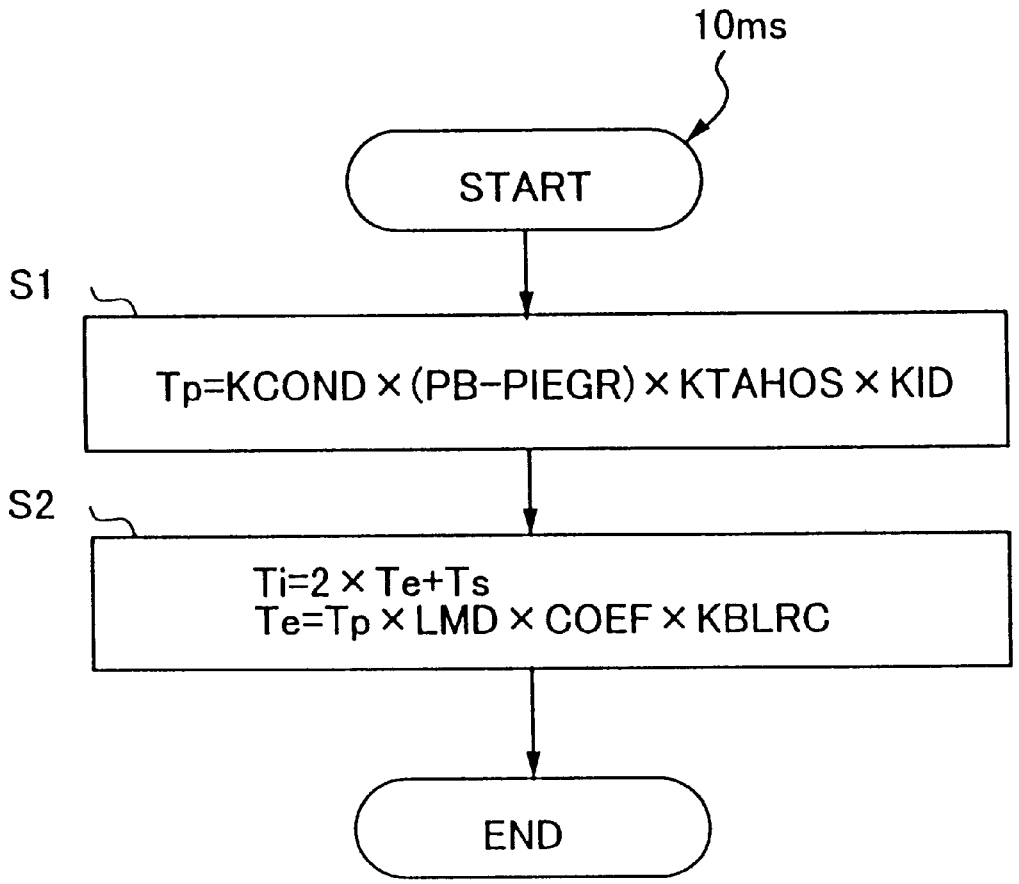
FIG. 3 is a flowchart detailedly showing the fuel injection quantity control according to the above embodiment of the present invention.

A routine shown in the flowchart of FIG. 3 is executed for each 10 ms. First, in step 1 (denoted by S1 in the drawing, the same holds hereinafter), a basic fuel injection pulse width (basic fuel injection quantity) Tp is computed according to the following equation.

$$Tp=KCOND\times(PB-PIEGR)\times KTAHOS\times KID$$

Where, KTAHOS is a correction coefficient (correction amount) in response to an intake air temperature set in the flowchart of FIG. 4 described later, and is used for correcting the fuel injection quantity in accordance with density change due to a change of the intake air temperature. Further, KCOND is a constant, PIEGR is a residual gas pressure set on the basis of the intake air pressure PB, engine rotational speed and an atmosphere, and KID is a correction coefficient in idling.

The operation process for computing the basic fuel injection pulse width (basic fuel injection quantity) Tp based on the above correction coefficient KTAHOS corresponds to the fuel injection quantity correcting device D.

In the next step S2, the final fuel injection pulse width (fuel injection quantity) Ti is computed according to the following equation on the basis of the basic fuel injection pulse width (basic fuel injection quantity) Tp.

$$Ti=2\times Te+TS$$

$$Te=Tp\times LMD\times COEF\times KBLRC$$

Where, Ts is a correction for responding to a change of ineffective fuel injection quantity by a battery voltage, and the voltage correction portion Ts is added to an effective fuel injection pulse width Te to compute the final fuel injection pulse width (fuel injection quantity) Ti. The function of computing the final fuel injection pulse width (fuel injection quantity) Ti corresponds to the control device C.

The effective fuel injection pulse width Te is computed in a manner of correcting the basic fuel injection pulse width (basic fuel injection quantity) Tp on the basis of an air-fuel ratio feedback correction coefficient LMD, various correction coefficients COEF, an air-fuel ratio learning correction coefficient KBLRC or the like.

The air-fuel ratio feedback correction coefficient LMD is set so that an air-fuel ratio of burning air-fuel mixture is detected on the basis of oxygen concentration of exhaust gas detected by an oxygen sensor (not shown) and the air-fuel ratio approximates to a target air-fuel ratio. The air-fuel ratio learning correction coefficient KBLRC is set by learning the air-fuel ratio feedback correction coefficient LMD for each driving region so that a target air-fuel ratio is obtained without the correction coefficient LMD. Various correction coefficients COEF are set inclusive of an increase correction coefficient corresponding to water temperature, a starting and after-starting increase coefficient, an acceleration increase coefficient or the like.

Next, a process for setting the correction coefficient KTAHOS (second correction amount) will be described in detail with reference to the flowchart shown in FIG. 4.

Figure 4:
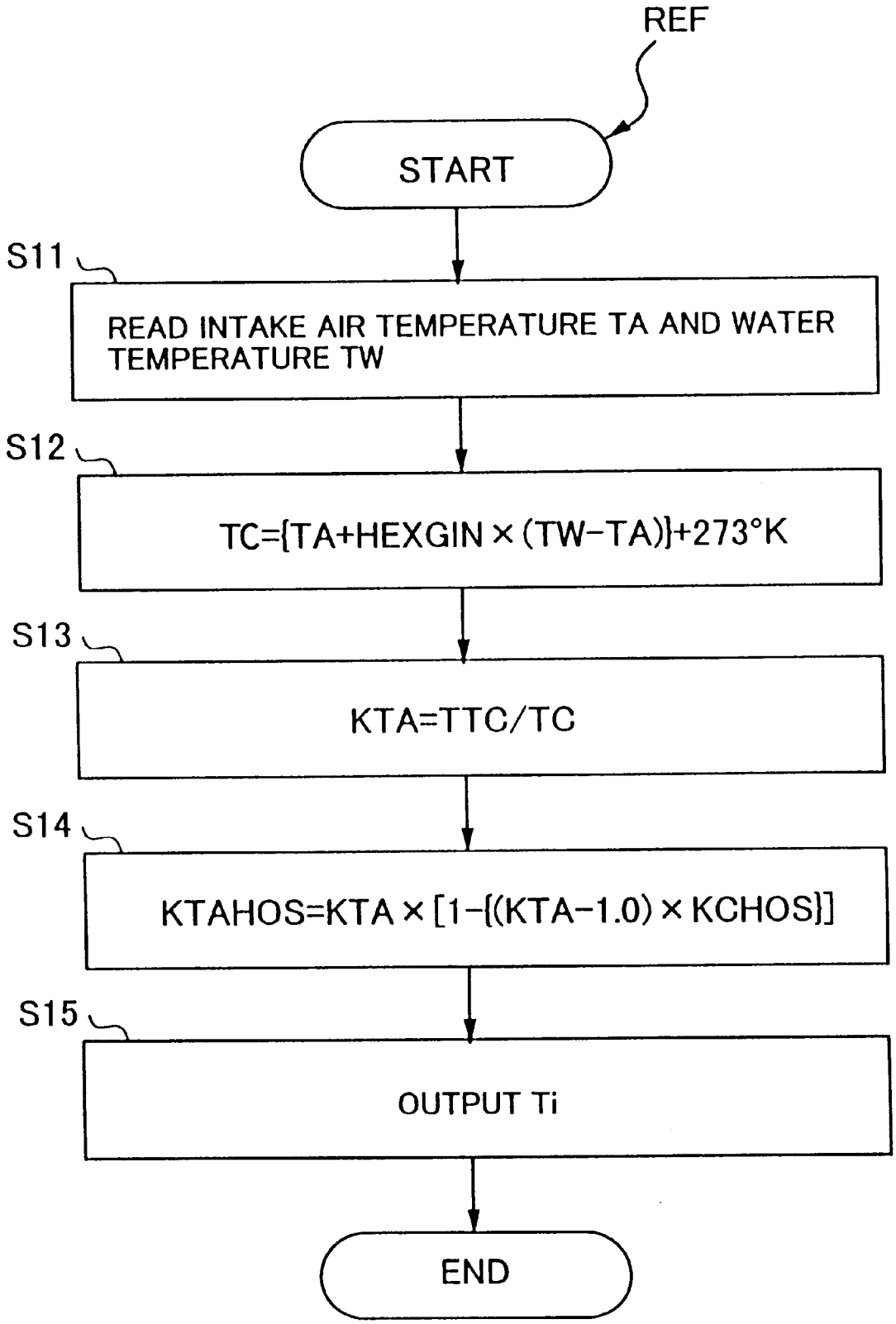
FIG. 4 is a flowchart showing a process for setting a correction coefficient on the basis of an intake air temperature according to the above embodiment of the present invention.

A routine as shown in the flowchart FIG. 4 is executed for each reference crank angle position REF. First, in step S11, detection signals intake air temperature TA, cooling water temperature TW and the like are read.

In the next step S12 (intake air temperature operating device), an intake air temperature (absolute temperature) TC of the cylinder is computed according to the following equation with the use of a previously stored cylinder heat-transfer coefficient HEXGIN.

$$TC=[TA+HEXGIN\ (TW-TA)]+273°\ K$$

More specifically, assuming that an intake air passed through the portion where the intake air temperature sensor 7 is located changes in temperature in accordance with a deviation between the intake air temperature TA (equivalent to outer air temperature) detected the intake air temperature sensor 7 and the cooling water temperature TW which is a temperature corresponding to the intake manifold temperature, and then, is sucked in the cylinder, the intake air temperature of the cylinder is estimated. In this case, the greater the deviation between the intake air temperature TA and the cooling water temperature TW becomes, the greater the temperature variation (transfer of heat quantity) until the intake air is sucked into the cylinder from the intake air temperature sensor 7 becomes. Therefore, detection result by the intake air temperature sensor 7 is further greatly corrected.

Since the intake air temperature of the cylinder is estimated according to the above equation, by adapting only cylinder heat-transfer coefficient HEXGIN, it is possible to readily execute an estimation control for the intake air temperature of the cylinder.

In step S13 (first correction amount operating device), a first correction amount coefficient (first correction amount) KTA is computed according to the following equation on the basis of the estimated intake air temperature (absolute temperature) TC of the cylinder.

$$KTA=TTC/TC$$

Where, TTC is a cylinder intake air temperature (reference cylinder intake air temperature) under previously stored reference environment. Preferably, the reference environment is set as a normal environment condition such that the cooling water temperature TW is 80 to 90° C. and the intake air temperature TA is 20 to 25° C., for example. The TTC is an estimated temperature when substituting a parameter of the reference environment condition for the equation of TC=[TA+HEXGIN (TW−TA)]+273° K. Therefore, in the case of the same condition as the reference environment, the computed correction coefficient KTA is 1.0.

In the operation of the fuel injection quantity, matching of the constant KCOND is carried out on the basis of the reference environment. Under such reference environment, the correction coefficient KTA is set to 1.0, whereby the operation for fuel injection quantity corresponding to the actual air density is carried out.

In the case where the environmental condition is different from the reference environment, that is, in the case where the intake air temperature TA and the cooling water temperature TW are different from those of the reference environment, the correction coefficient KTA is set in accordance with a ratio of the reference intake air temperature and the estimated intake air temperature. If the environmental condition transfers to the side where the intake air temperature of the cylinder becomes lower, the operation is carried out for the correction coefficient KTA which exceeds the value 1.0 for fuel injection increase correction. On the other hand, the environmental condition transfers to the side where the intake air temperature of the cylinder becomes higher, the operation is carried out for the correction coefficient KTA which is less than the value 1.0 for fuel injection decrease correction.

Thereby, if the intake air temperature increases and decreases with respect to the reference environment and the air density changes in response to the increase and decrease, the fuel injection quantity is corrected in accordance with the air density at this time.

In step S14 (second correction amount operating device), the final correction coefficient KTAHOS (second correction amount) is computed according to the following equation on the basis of the aforesaid first correction coefficient (first correction amount) KTA and a previously stored air density fine adjustment coefficient KCHOS.

$$KTAHOS=KTA\times[1.0-\{(KTA-1.0)\times KCHOS\}]$$

According to the above equation, if the first correction coefficient KTA becomes greater than 1.0 which is the value under the reference environment, the correction coefficient KTA is adjusted so as to greater decrease. On the other hand, if the first correction coefficient KTA becomes smaller than 1.0, the correction coefficient KTA is adjusted so as to increase. Thus, the adjusted result is computed as the final correction coefficient KTAHOS (second correction amount).

The first correction coefficient KTA computed from the above equation KTA=TTC/TC changes in proportion to a change of the estimated intake air temperature TC. However, the actual correction requirement is smaller than the above proportional change. In view of such circumstances, in the case where a correction level by the first correction amount KTA becomes greater (the absolute value of the deviation between KTA and the value 1.0 becomes greater), the correction level is made small so as to correspond to the actual correction requirement. In other words, the error in the operation for the cylinder intake air temperature (absolute temperature) TC is corrected with use of the air density fine adjustment coefficient KCHOS.

The function as described in the above steps S13 and S14 is equivalent to the correction amount operating device, and on the basis of the correction coefficient KTAHOS (second correction amount) computed in step S14, the basic fuel injection pulse width Tp is computed in step S1 of the flowchart shown in FIG. 3.

In the next step S15, a fuel injection pulse width (fuel injection quantity) Ti newly computed according to the flowchart of FIG. 3 is set, and then, the fuel injection valve 4 is driven controlled in accordance with the pulse width.

What is claimed is:

1. A fuel injection control apparatus for an internal combustion engine, comprising:

intake air pressure detecting means for detecting an intake air pressure of an engine;

control means for controlling a fuel injection quantity to said engine on the basis of an intake air pressure detected by said intake air pressure detecting means;

intake air temperature detecting means for detecting an intake air temperature of an intake manifold of said engine;

intake manifold temperature detecting means for detecting a temperature of said intake manifold;

intake air temperature operating means for computing a cylinder intake air temperature on the basis of said intake air temperature, and a deviation between said intake air temperature and said intake manifold temperature;

correction amount operating means for computing a correction amount for correcting said fuel injection quantity on the basis of the cylinder intake air temperature computed by said intake air temperature operating means and a previously stored reference cylinder intake air temperature; and fuel injection quantity correcting means for correcting said fuel injection quantity on the basis of the correction amount computed by said correction operating means.

2. A fuel injection control apparatus for an internal combustion engine according to claim 1, wherein said intake air temperature operating means, when the intake air temperature detected by said intake air temperature detecting means is set as TA, the intake manifold temperature detected by said intake manifold temperature detecting means is set as TW and the cylinder intake air temperature is set as TC, carries out an operation with the use of a previously stored cylinder heat-transfer coefficient HEXGIN on the basis of an equation of TC=[TA+HEXGIN (TW−TA)]+278° K so as to compute the intake air temperature.

3. A fuel injection control apparatus for an internal combustion engine according to claim 1, wherein said correction amount operating means includes:

first correction amount operating means for computing a first correction amount on the basis of a previously stored reference cylinder intake air temperature and the cylinder intake air temperature computed by said intake air temperature operating means; and second correction amount operating means for computing a finally second correction amount on the basis of the first correction amount computed by said first correction amount operating means and a previously stored adjustment coefficient.

4. A fuel injection control apparatus for an internal combustion engine according to claim 3, wherein said reference cylinder intake air temperature is set as a cylinder intake air temperature computed by said intake air temperature detecting means on the basis of intake air temperature and intake manifold temperature to be references.

5. A fuel injection control apparatus for an internal combustion engine according to claim 3, wherein said first correction amount operating means, when the reference cylinder intake air temperature is set as TTC, the cylinder intake air temperature computed by said intake air temperature operating means is set as TC and said first correction amount is set as KTA, carries out an operation of the first correction amount KTA on the basis of an equation of KTA=TTC/TC, and said second correction amount operating means, when said adjustment coefficient is set as KCHOS and said second correction amount is set as KTAHOS, carries out an operation of the finally second correction amount KTAHOS on the basis of an equation of KTAHOS=KTA×[1.0−{(KTA−1.0)×KCHOS}].

6. A fuel injection control apparatus for an internal combustion engine according to claim 1, wherein said intake manifold temperature detecting means detects a cooling water temperature of said engine as a temperature corresponding to said intake manifold temperature.

7. A fuel injection control method for an internal combustion engine, comprising the following steps of:

detecting an intake air temperature of an intake manifold of an internal combustion engine;

detecting a temperature of said intake manifold;

estimating a cylinder intake air temperature on the basis of said intake air temperature and a deviation between said intake air temperature and the temperature of said intake manifold; and correcting a fuel injection quantity based on an intake air pressure of said internal combustion engine in accordance with said estimated intake air temperature of said cylinder and a previously stored reference cylinder intake air temperature.

8. A fuel injection control method for an internal combustion engine according to claim 7, wherein when the intake air temperature detected in said intake manifold is set as TA, the intake manifold temperature is set as TW and the intake air temperature of said cylinder is set as TC, an intake air temperature of said cylinder is estimated with the use of a previously stored cylinder heat-transfer coefficient HEXGIN on the basis of an equation of TC=[TA+HEXGIN (TW−TA)]+273° K.

9. A fuel injection control method for an internal combustion engine according to claim 7, wherein a first correction amount is computed on the basis of a previously stored reference cylinder intake air temperature and said estimated cylinder intake air temperature, and thereafter, a finally second correction amount is computed on the basis of said first correction amount and a previously stored adjustment coefficient.

10. A fuel injection control method for an internal combustion engine according to claim 9, wherein said reference cylinder intake air temperature is estimated on the basis of the intake air temperature and intake manifold temperature to be references.

11. A fuel injection control method for an internal combustion engine according to claim 9, wherein when the reference cylinder intake air temperature is set as TTC, said estimated cylinder intake air temperature is set as TC and said first correction amount is set as KTA, an operation of the first correction amount KTA is carried out on the basis of an equation of KTA=TTC/TC, and when said adjustment coefficient is set as KCHOS and said second correction amount is set as KTAHOS, an operation of the finally second correction amount KTA- HOS is carried out on the basis of an equation of KTAHOS=KTA×[1.0−{(KTA−1.0)×KCHOS}].

12. A fuel injection control method for an internal combustion engine according to claim 7, wherein a cooling water temperature of said engine is detected as a temperature corresponding to said intake manifold temperature.

* * * * *